US008800900B2

(12) United States Patent
Gharagozlu

(10) Patent No.: US 8,800,900 B2
(45) Date of Patent: Aug. 12, 2014

(54) METHOD AND DEVICE FOR COMMINUTING ORE

(76) Inventor: Parviz Gharagozlu, San Felipe (CL)

( * ) Notice: Subject to any disclaimer, the term of this patent is extended or adjusted under 35 U.S.C. 154(b) by 0 days.

(21) Appl. No.: 13/499,432

(22) PCT Filed: Sep. 30, 2010

(86) PCT No.: PCT/EP2010/005979

§ 371 (c)(1),
(2), (4) Date: Jun. 11, 2012

(87) PCT Pub. No.: WO2011/038914

PCT Pub. Date: Apr. 7, 2011

(65) Prior Publication Data

US 2013/0048766 A1 Feb. 28, 2013

(30) Foreign Application Priority Data

Sep. 30, 2009 (DE) ..... 10 2009 047 818

(51) Int. Cl.
*B02C 25/00* (2006.01)
*B02C 7/04* (2006.01)

(52) U.S. Cl.
USPC ..... 241/30; 241/261.3

(58) Field of Classification Search
USPC ..... 241/261.3, 261.2, 248, 21, 30
See application file for complete search history.

(56) References Cited

U.S. PATENT DOCUMENTS

| | | | | | |
|---|---|---|---|---|---|
| 254,813 | A | * | 3/1882 | Gathmann | 241/261.3 |
| 874,925 | A | * | 12/1907 | Bartz et al. | 241/261.3 |
| 962,807 | A | * | 6/1910 | Alsted | 241/251 |
| 1,435,130 | A | * | 11/1922 | Hogan | 241/296 |
| 1,494,684 | A | * | 5/1924 | Gross | 241/248 |
| 1,523,070 | A | * | 1/1925 | Hush | 241/261.2 |
| 3,314,617 | A | * | 4/1967 | Sargood | 241/261.3 |
| 4,034,921 | A | * | 7/1977 | Schnitzer | 241/157 |
| 4,283,016 | A | * | 8/1981 | Reinhall | 241/21 |

(Continued)

FOREIGN PATENT DOCUMENTS

| | | | |
|---|---|---|---|
| CH | 697639 | B1 | 12/2008 |
| DE | 400229 | C | 8/1924 |
| GB | 1474550 | A | 5/1977 |
| WO | 2010074604 | A1 | 7/2010 |

OTHER PUBLICATIONS

PCT International Search Report Dated Mar. 23, 2011, Applicant Parviz Gharagozlu, Application No. PCT/EP/2010/005979, 3 pages.

(Continued)

*Primary Examiner* — Faye Francis
(74) *Attorney, Agent, or Firm* — Brooks Kushman P.C.

(57) ABSTRACT

A device and method for comminuting ore and/or slag with an ore feeding unit for feeding ore to a pulverizer, wherein the pulverizer includes at least two comminuting elements that form at least one comminuting space for the ore such that, by a relative movement in the form of a rotation of at least one of the comminuting elements, the ore is pulverized. One or more accelerating elements are provided on the at least one of the comminuting elements for accelerating and comminuting the ore by the rotation of one of the comminuting elements. An intermediate space is provided between two comminuting elements and/or in at least one of the comminuting elements, through which the pulverized ore, during the rotation, is transported from the center of rotation, and an outlet unit is provided, which is connected to the intermediate space and through which the pulverized ore is discharged.

13 Claims, 13 Drawing Sheets

(56) References Cited

U.S. PATENT DOCUMENTS

| | | | | |
|---|---|---|---|---|
| 4,502,643 | A * | 3/1985 | Burggrabe | 241/257.1 |
| 4,830,293 | A * | 5/1989 | Furuichi et al. | 241/163 |
| 5,167,373 | A * | 12/1992 | Bohn et al. | 241/28 |
| 5,335,865 | A * | 8/1994 | Kohler et al. | 241/28 |
| 5,531,385 | A * | 7/1996 | Witsken | 241/21 |
| 5,975,440 | A * | 11/1999 | Watson | 241/18 |
| 6,402,067 | B1 * | 6/2002 | Webster | 241/28 |
| 6,616,078 | B1 * | 9/2003 | Gingras | 241/261.2 |
| 6,926,216 | B2 * | 8/2005 | Healey | 241/252 |
| 7,191,967 | B2 * | 3/2007 | Vuorio et al. | 241/261.3 |
| 2002/0070303 | A1 * | 6/2002 | Johansson et al. | 241/261.3 |
| 2002/0112826 | A1 * | 8/2002 | Kriebel et al. | 162/23 |
| 2006/0192040 | A1 * | 8/2006 | Johansson | 241/30 |
| 2009/0140084 | A1 * | 6/2009 | Horigane | 241/6 |

OTHER PUBLICATIONS

PCT International Preliminary Report on Patentability Dated Jan. 17, 2012, Applicant Parviz Gharagozlu, Application No. PCT/EP0210/005979, 12 pages.

* cited by examiner

METHOD AND DEVICE FOR COMMINUTING ORE

CROSS-REFERENCE TO RELATED APPLICATIONS

This application is a U.S. national phase of PCT Application No. PCT/EP2010/005979 filed Sep. 30, 2010, which claims priority to German Application No. 10 2009 047 818.3 filed Sep. 30, 2009, the disclosures of which are incorporated in their entirety by reference herein.

TECHNICAL DOMAIN

The present invention relates to a method and to a device for comminuting ore or stone and/or in particular slag, the ore being pulverised using water in a wet process or also without using water in a dry process in a particularly ecological manner.

There is a great need to also use environmentally friendly methods and devices when extracting raw materials, in particular in order to protect the people involved from damage to their health. With the conventional comminution of ore the people involved in the mining have their health compromised by the development of dust which may affect the lungs of the people in question.

Furthermore, there is a need to improve the methods and devices used for mining, and in particular for the processing of ore, such that energy consumption is reduced and damage to the environment is minimised.

PRIOR ART

Ball mills for comminuting ore have been known for a long time, the ore being set in rotation together with iron balls until the desired fineness has been achieved in the ball mill. This type of known ball mill is already known from DE 40 02 29, the grinding cylinder containing balls, flints or similar in order to grind up the ore.

However, in such known ball mills the grinding cylinder must be designed to be particularly robust in order to be able to withstand the balls striking against the cylinder wall without any damage, and for this reason the weight of the grinding cylinder is greatly increased. Consequently, the operating costs and energy input are high with such ball mills. Furthermore, the rotating grinding cylinder is subject to a high degree of wear as a result of the balls striking against the grinding cylinder, and so after a relatively short time both the balls and the grinding cylinder have to be replaced. Moreover, it is necessary with ball mills for the ore to be ground by a separate comminuting unit and then by one or more ball mills connected one behind the other in order to comminute the ore in the desired manner, effective pulverisation of the ore hardly being possible.

Moreover, such ball mills are not suitable for comminuting or pulverising ore together with slag or slag on its own because slag, which is produced in particular as a waste product when further processing ore, is very brittle and has a hard structure.

DESCRIPTION OF THE INVENTION

It is therefore the object of the present invention to provide a method and a device for comminuting ore and/or in particular slag which is highly effective and only shows a small amount of wear, the ore being pulverised in the desired manner.

The invention is based upon the idea of providing a method and a device for comminuting ore, the device according to the invention comprising an ore feed unit for feeding ore to be comminuted to a pulveriser. The pulveriser is composed of at least two comminuting elements that can be moved relative to each other, which elements form at least one comminuting space for the ore to be comminuted with each other such that, by a relative movement in the form of a rotation of at least one of the two comminuting elements the ore to be comminuted is pulverised in that one or more accelerating elements, in particular protrusions, are provided on at least one of the comminuting elements, said accelerating elements being arranged in particular on the end face of one of the two comminuting elements and accelerating and comminuting the ore to be comminuted by the rotation of one of the two comminuting elements. The ore is thereby on the one hand pulverised by the direct effect of one of the two comminuting elements, and on the other hand the ore is advantageously pulverised in that ore with different directions of movement and different speeds of movement is to be found in the comminuting space due to the rotation of the accelerating elements, the protrusions or recesses of the accelerating elements accelerating the ore to be comminuted away from the angular region towards the other comminuting element or towards the comminution space in particular by means of the inclined angular region opposite the face side so that the striking of this differently accelerated ore also provides pulverisation by means of the so-called micro-impact of ore.

When protrusions or recesses are provided as accelerating elements on one of the two comminuting elements, acceleration of the ore to be comminuted is produced particularly easily due to the rotation and the different relative speeds of the two comminuting elements. Thus, for example, the two comminuting elements can rotate in opposite directions or a comminuting element is fixed, and the other comminuting element rotates in order to achieve a relative movement between the two comminuting elements.

Particularly advantageously, the accelerating elements or the protrusions act upon the ore to be comminuted such that ore to be comminuted is moved away from the accelerating elements or protrusions or recesses with an inclined angular region such that part of the ore to be comminuted is accelerated by the protrusions in the direction of the other comminuting element or in the direction of the comminuting space and here strike other parts of the ore to be comminuted such as to form a micro-impact because the differently accelerated parts of the ore strike in the comminuting space between the two comminuting elements such as to form a micro-impact and so, particularly advantageously, the micro-impact between differently accelerated parts of the ore provides particularly advantageous pulverisation. In particular, the ore to be comminuted is accelerated by the accelerating elements such that the latter have an inclined region or angular region in the form of protrusions or recesses which by the rotation of the comminuting element forms a defined angle between the end face of the comminuting element and the accelerating element turning due to the rotation of the comminuting element, in this way in the comminuting space a particularly advantageous micro-impact between the ore accelerated by the accelerating elements and an ore with a different relative speed and a different acceleration direction striking, thus forming a micro-impact, and thus providing particularly advantageous pulverisation in the comminuting space.

After the pulverisation in the comminuting space between the two comminuting elements the pulverised ore is conveyed from the centre of rotation outwards, in particular due to the centrifugal force and the force of gravity, into an intermediate space which is provided between the two comminuting elements and/or in at least one of the two comminuting elements. The pulverised ore passes from the intermediate space to an outlet unit, it being collected here by means of the outlet unit, for example due to the force of gravity or being sucked out through the outlet unit in order to discharge the pulverised ore from the device according to the invention.

Due to the clashing of the ore to be comminuted with the accelerating elements and the further micro-impact between the differently accelerated ore in the comminuting space the ore is pulverised particularly effectively, in contrast to known devices the pulverisation taking place over a short time and in a comminuting space with small dimensions, and this leads to the device according to the invention only having small dimensions. Thus, the dimensions and in particular the wall thicknesses of the rotating and optionally also fixed comminuting elements are only small, accordingly also only a small amount of wear occurring and high efficiency being achieved. Consequently, the energy input both during production and during operation of the device according to the invention is likewise low, by means of which the production costs of the device according to the invention and the operating costs in relation to known devices are also particularly advantageous. Due to this type of pulverisation it is not necessary to use additional loose grinding elements, such as for example steel balls which are known from ball mills with corresponding iron or steel balls.

In particular, only slight wear is produced with the device according to the invention by the micro-impact, i.e. by the repeated striking of differently accelerated ore, by means of which the mechanical elements are only slightly stressed, no additional loose grinding elements or iron balls having to be used either.

A further significant advantage of the device according to the invention and the method according to the invention is that pre-comminuting of the ore obtained from mining is not required, and so the device according to the invention replaces not only the known ball mills, but also corresponding devices for comminuting ore, which may in particular be composed of two rollers rotating in relation to one another.

Moreover, the device according to the invention and the method according to the invention also make it possible for slag on its own or together with ore to be comminuted and pulverised because due to the small dimensions of the comminuting space and the relatively small dimensions of the comminuting elements with a corresponding rotation greater forces act upon the ore to be comminuted and the slag to be comminuted and so effective pulverisation takes place. By means of the rotation, which due to the dimensions can comprise 100 to approximately 2000 turns per minute of a comminuting element, slag which is very brittle and has a hard structure can also be effectively pulverised.

Further advantageous embodiments emerge from the subclaims. It is thus advantageous if one or more accelerating elements, in particular protrusions, are respectively provided on both comminuting elements, there being a different relative speed between the accelerating elements of the one comminuting element and those of the other comminuting element because in this way pulverisation is improved and accelerated. In particular, the accelerating elements which are attached both to the one comminuting element and to the other comminuting element, provide a particularly effective micro-impact due to their different relative speeds, in particular when the accelerating elements of the one and of the other comminuting element are aligned to one another such that the ore elements to be comminuted are respectively accelerated by the accelerating elements of the one and of the other comminuting element in substantially opposite directions, in this way the striking of these ore elements accelerated in opposite directions having a particularly positive effect and leading to fast and effective pulverisation of the ore material.

Furthermore, it is particularly advantageous if the two comminuting elements are composed of a stationary fixed element and a rotating turning element, the fixed element having substantially in its centre a feed opening for feeding the ore to be comminuted, and the two comminuting elements being accommodated in a housing which comprises the outlet unit, in particular in the form of an outlet opening. Since in the device according to the invention the delivered ore can be pulverised without any pre-comminuting, the device according to the invention makes it possible for the dust that develops during pulverisation of the ore to not penetrate to the outside.

A further advantage is that the turning element can be set in rotation, at least relative to the fixed element, by means of a motor, the comminuting space being formed between the fixed element and the turning element by corresponding recesses, which act as accelerating elements, being provided in at least the turning element and/or the fixed element so that the ore is pulverised by the relative movement between the fixed element and the turning element. The recesses in the end face of the comminuting elements are particularly simple in design in order to accelerate the ore to be comminuted. The recesses can also form corresponding protrusions here, in particular both with the recesses and with the protrusions an angular region which is formed between the outer end face of the comminuting elements and the recesses being especially advantageous because this angular region can be set at an incline such that the rotation of the comminuting element provides an effective transfer of force to the ore to be accelerated.

According to a preferred embodiment the comminuting space between the fixed element and the turning element is formed substantially conically tapering outwards from the axis of rotation of the turning element.

In order to vary the rotation of the turning element, the rotation of the turning element can be varied by a gearing mechanism or an adjustable belt drive so that the motor can be respectively driven with optimised operating parameters.

If the turning element has a ramp region with a rising incline as part of the comminuting space by means of which the ore and/or in particular the slag to be comminuted is accelerated and comminuted, in addition to the protrusions and recesses advantageous comminution of the ore and/or the slag can additionally take place by means of the cross-section of the ramp region which differs with the rotation of the turning element. It is particularly advantageous if the ramp region is provided after the feed opening of the fixed element and before the protrusions and/or recesses of the two comminuting elements in the direction of conveyance of the ore and/or the slag in order to provide pre-comminuting prior to pulverisation by means of the protrusions and/or recesses.

According to a preferred embodiment the intermediate space between the two comminuting elements can be adjusted in the axial direction of the rotation by a variable distance between the two comminuting elements, the intermediate space comprising in particular star-shaped outlet notches leading away from the axis of rotation of the turning element in the turning element or the fixed element. By means of the variable setting of the distance between the two comminuting elements the pulverisation and so the average grain size of the pulverised ore can be varied, i.e. with a larger distance between the two comminuting elements the pulverised ore has a larger average grain size and with a smaller distance between the two comminuting elements the average grain size of the pulverised ore is smaller. Thus, the result of the pulverisation can be predetermined arbitrarily by the operating staff as appropriate.

Furthermore, it is advantageous if there is likewise provided on the fixed element a ramp region which co-operates with the ramp region of the turning element in such a way that the ore to be comminuted is accelerated and comminuted by the inclines of both ramp regions. In particular, these ramp regions in the form of a worm can extend over a radial region on the end face of the two comminuting elements so that immediately after feeding the ore to be comminuted the latter together provide a size reduction of the ore and accelerate the latter.

It is thus advantageous according to the method and the device according to the invention that water is fed through a water inlet into the comminuting space and conveyed away together with the pulverised ore through the outlet unit. The use of water for pulverisation of the ore can promote the pulverisation process, the supply of water not necessarily being required. On the other hand, the supply of water reduces the development of dust which can have considerable consequences with regard to the health of the operating staff.

In conventional comminuting devices according to the prior art in which the ore must be pre-comminuted for further processing, for example in upstream comminution machinery such as for example rollers rotating in relation to one another, heavy dust develops such that the operating staff often suffers from silicosis. In contrast to the procedure according to the prior art, it is made possible by the device according to the invention and by the method according to the invention to pulverise ore, the ore being fed directly to the device according to the invention, and the development of dust from the dug up ore being avoided by using water. The operating staff is thus protected from silicosis because comminution of the dug up ore is not required with the method according to the invention or the device according to the invention.

In particular, it is possible by means of the device according to the invention for ore dug up in a mine to be processed directly without pre-comminution, the dug up ore being pulverised in one process. Consequently, pre-comminution units and then one or more ball mills according to the prior art are not required, and so by means of the device according to the invention a number of devices or treatment processes applied one after the other can be cut down on.

According to a preferred embodiment the pulveriser has a water inlet into the comminution chamber through which a predetermined amount of water is fed to the ore to be comminuted. The addition of water to the device according to the invention makes it possible to prevent the development of dust in the process for excavating pulverised ore.

In the following the invention will be described, purely by way of an example, by means of the attached figures.

DESCRIPTION OF A PREFERRED EMBODIMENT

Figure 1:
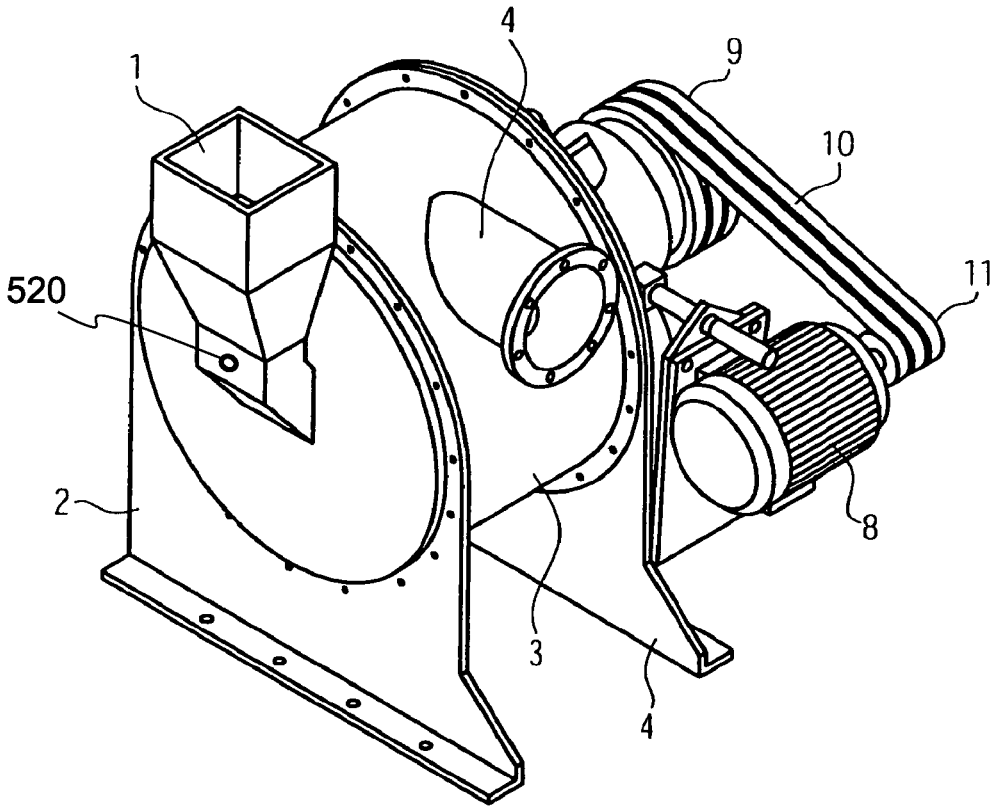
FIG. 1 shows a perspective view of the device according to the invention.

According to FIG. 1 the device according to the invention is illustrated, the ore to be comminuted or the slag to be comminuted being introduced into a funnel or feed funnel 1 which constitutes the ore feed unit. Alternatively, instead of a funnel a screw conveyor can also be provided which feeds the ore to be comminuted under pressure into the pulveriser. The ore is fed through the funnel 1 to the cylinder-like housing 3 which is mounted on one foot 2 and one foot 6. The pulverisation of the ore to be comminuted takes place in this housing 3. Here a motor 8 transfers the torsional moment from the motor 8 to the pulveriser by means of a drive roller 11 and a belt 10 and a belt pulley 9.

Figure 2:
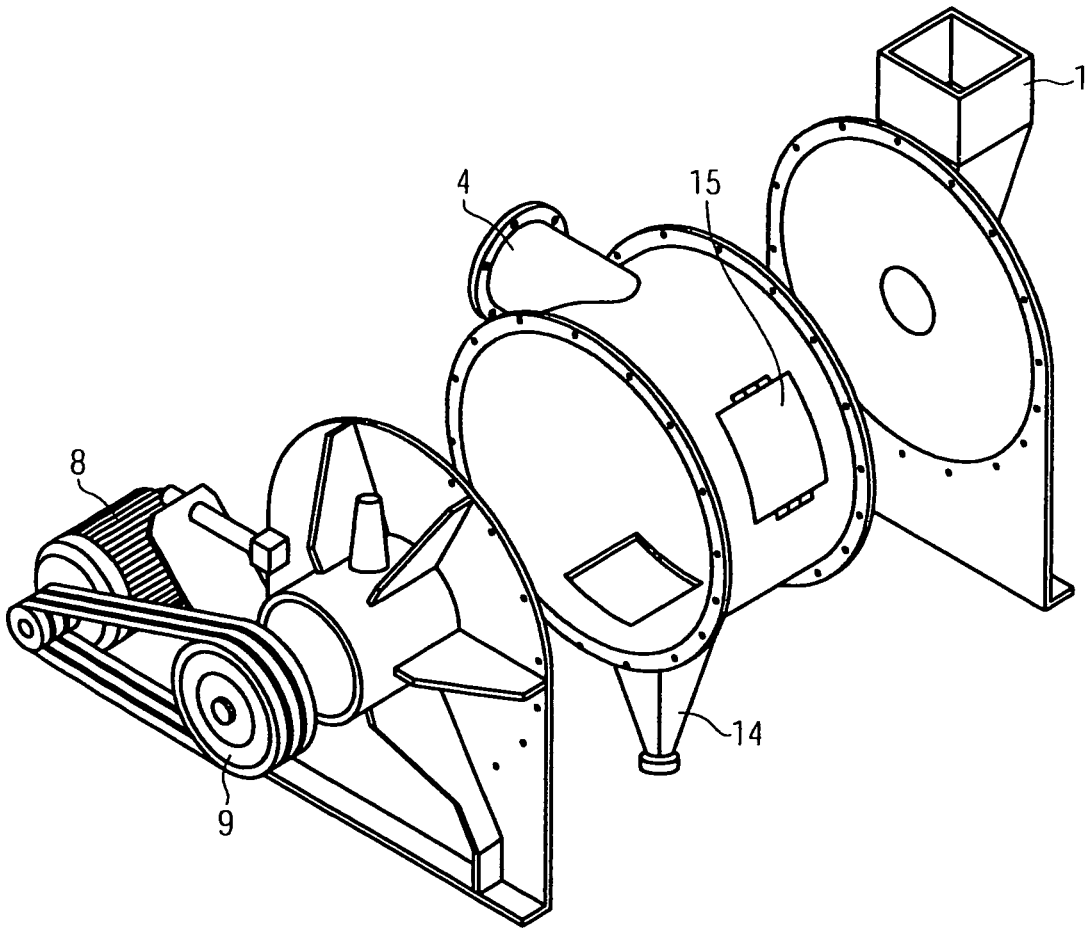
FIG. 2 shows an exploded representation of the device according to the invention of FIG. 1.

As can be gathered in particular from FIG. 2, a suction opening 4 is optionally possible through which the pulverised ore can be sucked out by means of negative pressure. Alternatively, and in particular as a rule, there is provided in the lower region of the housing 3 an outlet funnel 14 which generally forms the outlet unit. By means of this outlet funnel 14 the pulverised ore is discharged from the device according to the invention with the aid of the force of gravity or by suction.

Figure 3:
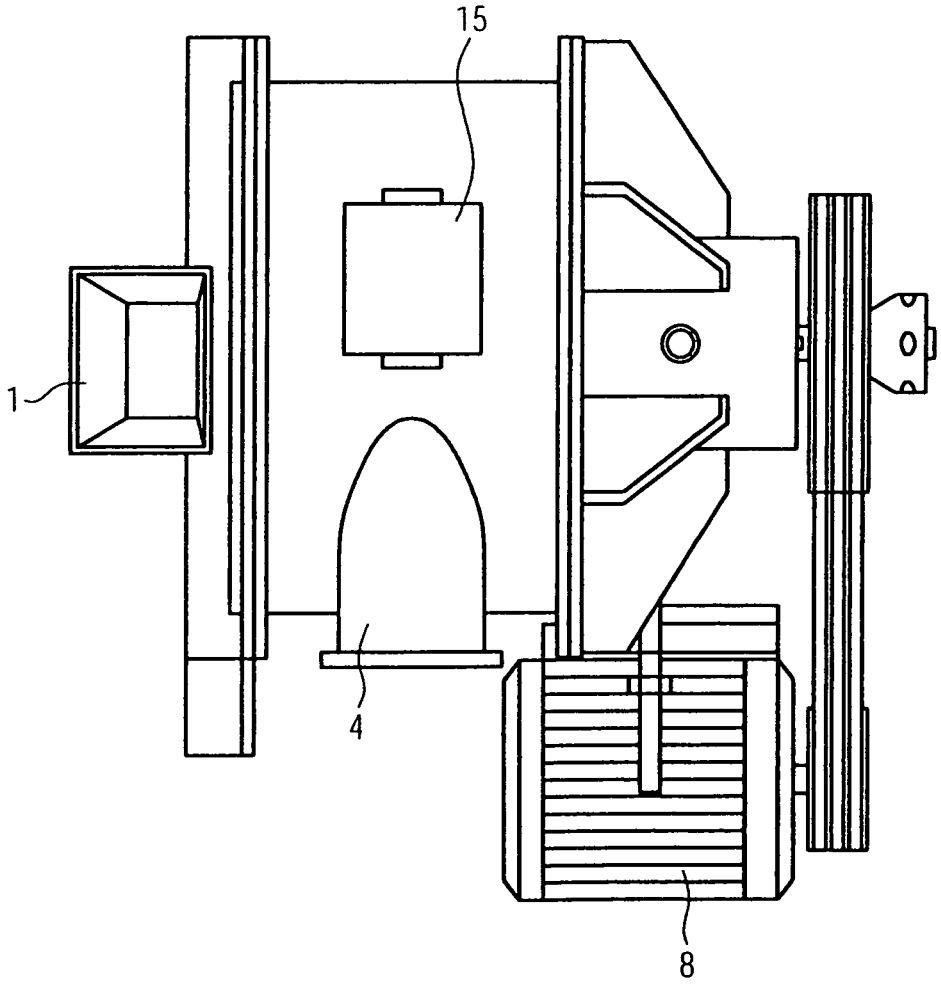
FIG. 3 shows a top view of the device according to the invention of FIG. 1.

A control flap 15 can be provided on the housing 3 in order to provide, if so required, access to the interior of the housing. However, this is not necessary for the function of the device according to the invention. As can be gathered in particular from FIG. 3, the control flap 15, like the feed funnel 1, is disposed in the upper region of the device according to the invention. Furthermore, the ore can be fed continuously to the pulveriser through the feed funnel or also non-continuously to the pulveriser if ore or slag is only fed sporadically to the device according to the invention.

Figure 4:
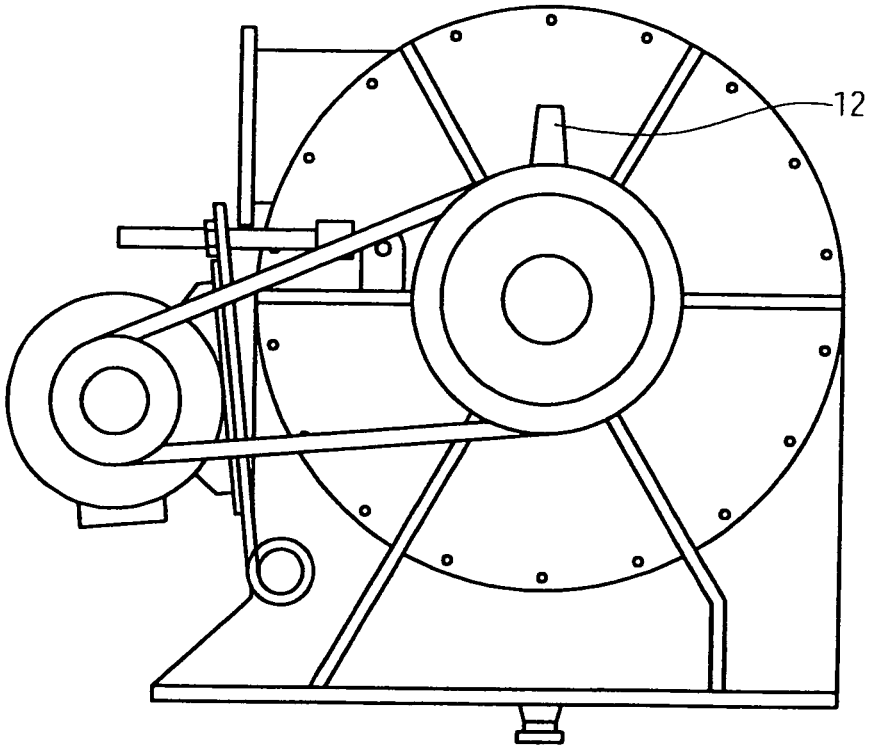
FIG. 4 shows a side view of the device according to the invention of FIG. 1.
Figure 5:
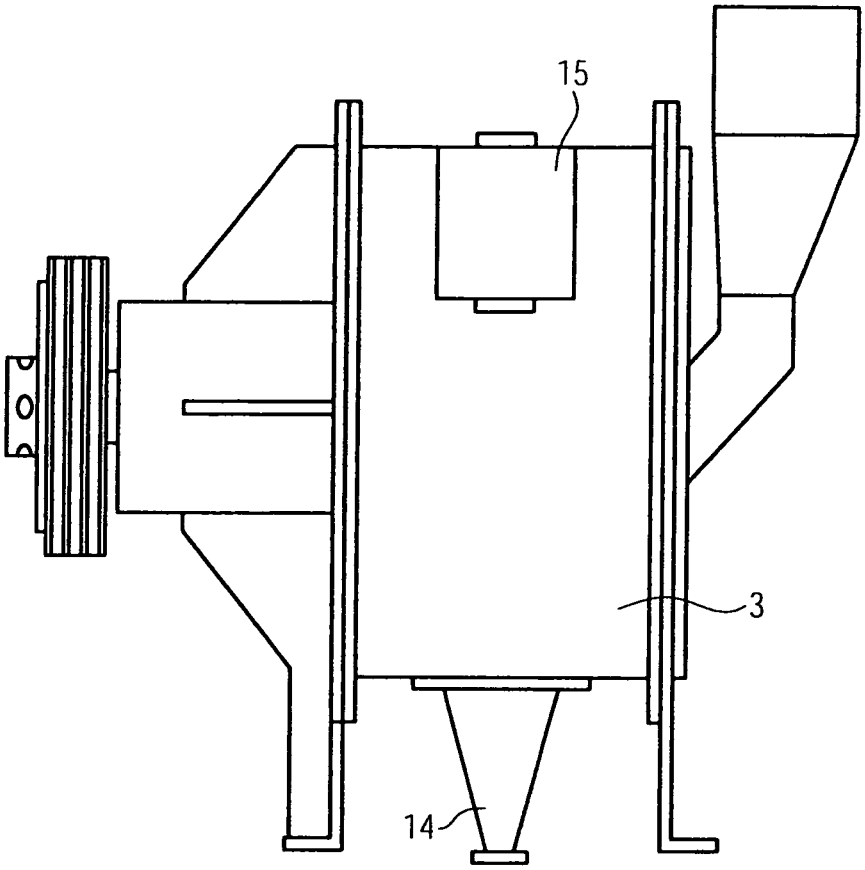
FIG. 5 shows a side view of FIG. 1.

FIGS. 4 and 5 respectively show a side view of the device according to the invention from which it is evident that the outlet funnel 14 is provided in the lower region of the cylinder-shaped housing 3.

Figure 6:
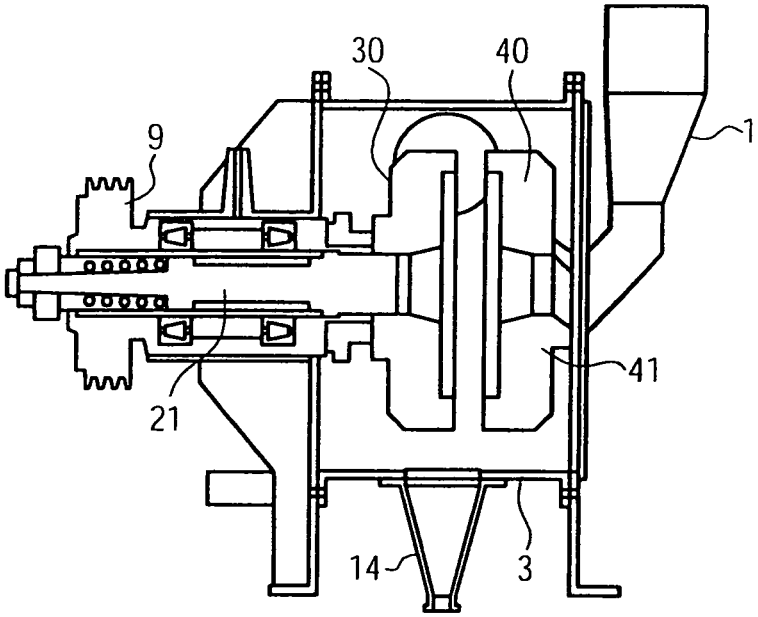
FIG. 6 shows the device according to the invention of FIG. 1, partially as a cross-section.

One can see in particular from FIG. 6 the function and the structure of the pulveriser. The belt pulley 9 is, as already described, driven by the motor 8 and transfers this torsional moment via a shaft 21 onto a comminuting element 30 which is thus rotating. In its simplest form the comminuting element 30 is designed as a rotating turning element 30 with a disc-like configuration which together with a stationary fixed element 40 forms the pulveriser. As can be seen from FIG. 6 the ore to be comminuted is fed via the inlet funnel 1 into the housing 3 by a feed opening 41 being provided substantially in the centre of the fixed element. The ore fed through the feed opening 41 is now pulverised between the fixed element 40 and the rotating turning element 30 and expelled or conveyed away radially outwards in pulverised form between the two comminuting elements 30, 40 and collected within the housing 3 in pulverised form and then discharged from the outlet funnel 14.

Figure 7:
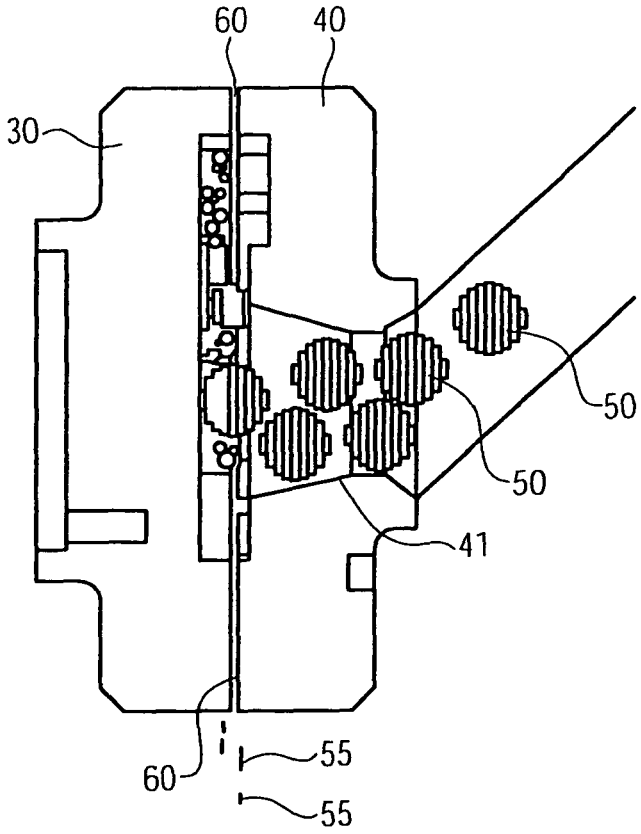
FIG. 7 shows diagrammatically the two comminuting elements of FIG. 6 as a cross-section.

The pulverisation is described in more detail, in particular with regard to FIG. 7. In the same way as in FIG. 6 the ore to be comminuted is fed via the feed opening 41, which is located substantially in the centre of the fixed element 40, into a comminuting space between the fixed element 40 and the turning element 30. FIG. 7 shows by way of example several lumps of ore 50 which represent the ore to be comminuted. After the lumps of ore 50 to be comminuted come into contact through the feed opening 41 with the turning element 30, the rotation of the turning element 30 causes the lumps of ore 50 to be accelerated radially outwards and in the rotational direction of the turning element 30. For this purpose the two comminuting elements form a comminuting space, one or more accelerating elements being disposed on at least the turning element or the fixed element in order to bring about acceleration and corresponding comminution of the ore that has been fed in. By means of the rotation of the turning element 30 the ore to be comminuted is pulverised directly by the contact with the turning element 30 and also by the contact between lumps of ore which have already been partially comminuted and also by contact with the fixed element 40 in the comminuting space. Due to the small amount of space required by the comminuting space, this type of pulverisation only requires a short time, the pulverised ore being conveyed away outwards through an intermediate space 60 between the two comminuting elements during the rotation of the turning element and by both comminuting elements, as shown for example by the pulverised ore 55 in FIG. 7. This means that the lumps of ore are pulverised by a relative movement in the form of a rotation between the two comminuting elements, according to a further embodiment it being possible to use two comminuting elements with different rotation speeds and the same or the opposite direction of rotation.

Figure 8:
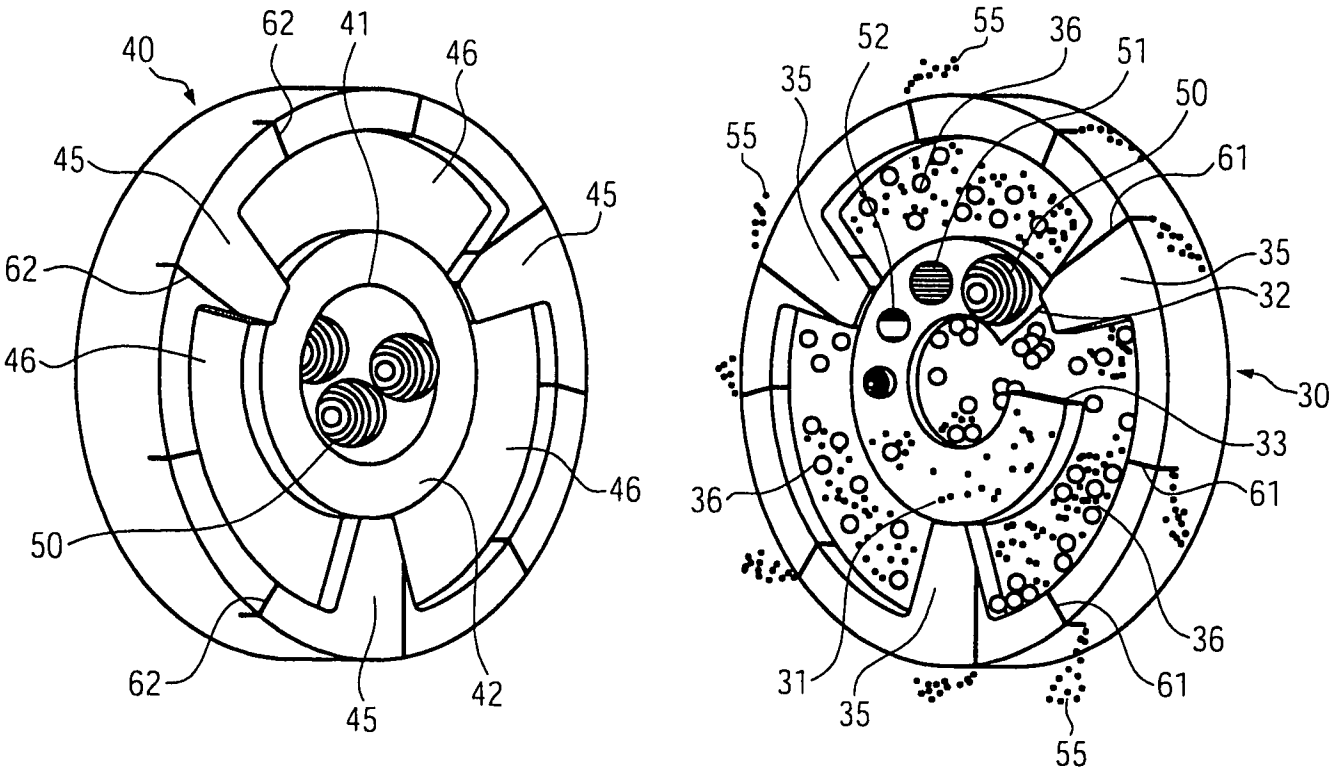
FIG. 8 shows the two comminuting elements of FIG. 7 in an opened up position.

FIG. 8 shows the two comminuting elements of FIG. 7 in the opened up state together with ore 50 to be comminuted and pulverised ore 55 positioned by way of an example. The ore 50 to be comminuted is fed via the feed opening 41 through the fixed element 40 into the comminuting space between the two comminuting elements, as already described. Optionally, the turning element 30 has a ramp region 31 which has a rising incline from the start of the ramp 32 to the end of the ramp 33 and can be part of the comminuting space. By means of the rotation of the turning element 30 the ore 50 to be comminuted is already comminuted due to the rising ramp region 31, as shown diagrammatically by the spherical particles of ore 51 and 52 which become smaller and smaller. The ramp region 31 co-operates here with an annular region 42 of the fixed element 40. Next the ore is accelerated and pulverised by protrusions 35 which act as accelerating elements due to the rotation of the turning element 30 and which are arranged equal distances apart in the circumferential direction of the turning element 30 in FIG. 8. The fixed element 40 can also have protrusions 45 which are arranged in the same way as the protrusions 35 of the turning element 30. Corresponding recesses 36 are provided on the end face of the turning element 30 between the protrusions 35 of the turning element as part of the comminuting space. The protrusions 35 are in particular at a predetermined angle in the cross-over to the recesses 36 in order to accelerate the ore to be comminuted both in the radial direction according to the rotation and also in the axial direction of the axis of rotation of the turning element. In this way the ore to be comminuted is accelerated into the centre of the comminuting space and strikes against other accelerated ore elements here so that notional pulverisation is produced by the micro-impact.

Optionally, the fixed element 40 has corresponding recesses 46 between the protrusions 45 of the fixed element 40. After the ore has been pulverised between the fixed element 40 and the turning element 30, in particular by the acceleration by means of the protrusions 35, the ramp region 31 and the protrusions 45 of the fixed element due to the rotation, the pulverised ore 45 passes into the intermediate space 60 between the two comminuting elements 30, 40.

As already described, the intermediate space 60 is formed by the variable distance between the two comminuting elements 30, 40, in addition to the variable distance star-shaped outlet notches 61 leading away from the axis of rotation of the turning element 30 also possibly being provided in the turning element 30. Similarly, outlet notches 62 are provided equal distances apart in the fixed element 40. As shown diagrammatically with regard to the turning element 30 in FIG. 8, the pulverised ore 44 is discharged outwards through the outlet notches 61 and 62. If the distance between the turning element 30 and the fixed element 40 is not provided, i.e. the two elements are substantially resting against one another, the pulverised ore 55 is substantially discharged outwards through the outlet notches 61 and 62. The variable distance between the two comminuting elements can be adjusted in particular by a hydraulic unit, and preferably the fixed element 40 can be positioned variably in the axial direction in relation to the turning element 30 in order to be able to adjust the pulverisation as regards size and composition, in particular for a different ore.

According to a further embodiment the fixed element 40 or the turning element 30 or both comminuting elements can be separated from one another hydraulically in the axial direction for repair and fitting work. Alternatively, the comminuting elements can be moved apart from one another out of the operating position by means of a pivot movement of one of the two comminuting elements. In this way the accelerating elements 35, for example, or other elements of the pulveriser subjected to high mechanical stress can be worked on or replaced. Furthermore, this makes it possible for elements subjected to high mechanical stress within the pulveriser or for example the accelerating elements of protrusions 35 to be able to be made of different materials and to be exchanged as required. In this way wearing parts within the comminuting space, such as for example the protrusions, can also be further adapted to different ores.

With regard to FIG. 6, which shows a diagrammatically enlarged distance between the turning element 30 and the fixed element 40, it is evident that with only a small distance the ore to be comminuted is thrown outwardly in the radial direction by the rotation and is contained by the housing 3 before the pulverised ore is discharged from the device according to the invention via the outlet funnel 14, for example by the force of gravity alone or additionally by a suction device or similar.

Figure 9:
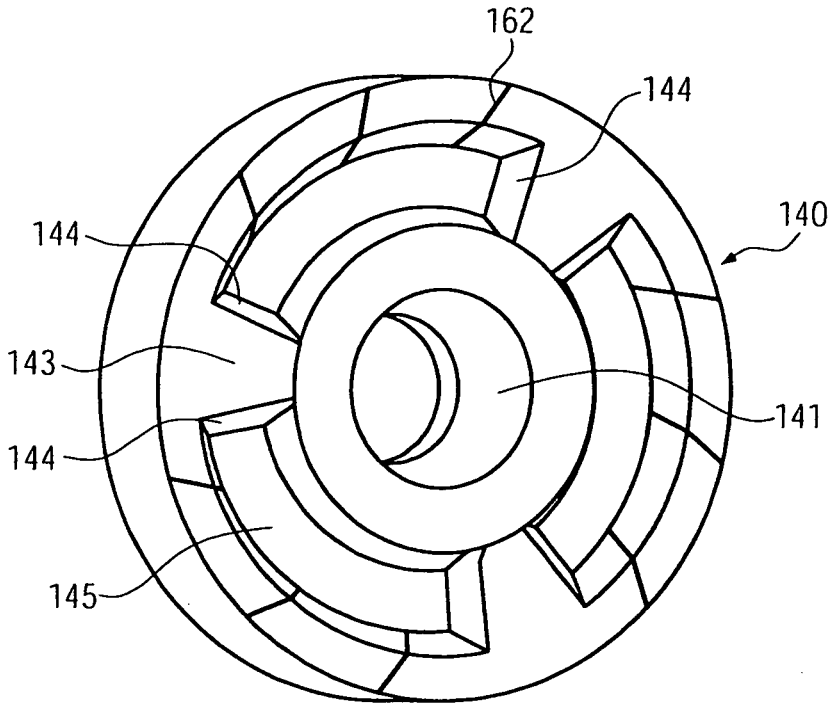
FIG. 9 shows a comminuting element similar to FIG. 8, illustrated diagrammatically.

FIG. 9 shows a further embodiment of a fixed element 140 which has a feed opening 141 in the centre. The fixed element 140 is substantially identical to that of FIG. 8, the fixed element 140 having outlet notches 162 set at an angle through which the pulverised ore is conveyed away to the outside.

In the form illustrated the fixed element 41 shown in FIG. 9 can also be used as a second turning element which can have a relative speed different to the turning element 30 illustrated in FIG. 8.

The embodiment of a comminuting element shown in FIG. 9 has an angular region 144 which extends respectively to both sides from the accelerating element 143 to the recess 145. However, these two angular regions 144 can also be provided on just one side of the accelerating element 143 depending on the rotational direction in order to accelerate the ore to be comminuted, depending on the direction of rotation of the comminuting element, both in the radial and in the axial direction in relation to the rotation of the comminuting element. In this way, together with the accelerating elements of the turning element 30 shown in FIG. 8, particularly effective pulverisation can be produced, in particular when the accelerating elements of the turning element 30 also have an angular region which is congruent to the angular regions 144 of the comminuting element of FIG. 9 or are arranged substantially in a mirror image of one another.

Figure 10:
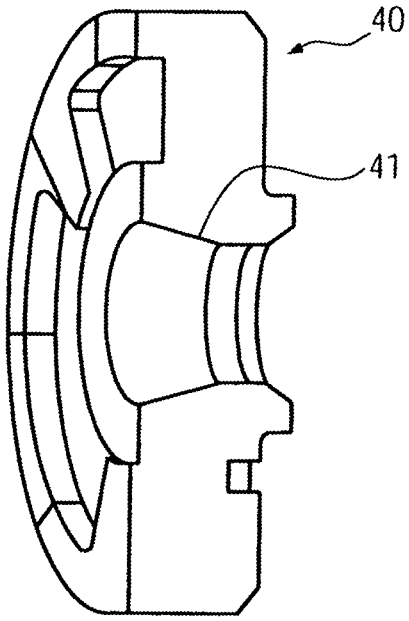
FIG. 10 shows the comminuting element of FIG. 8, partially as a cross-section.

FIG. 10 shows a cross-section of the fixed element 40 of FIG. 8, the feed opening 41 having a funnel-shaped structure.

Figure 11:
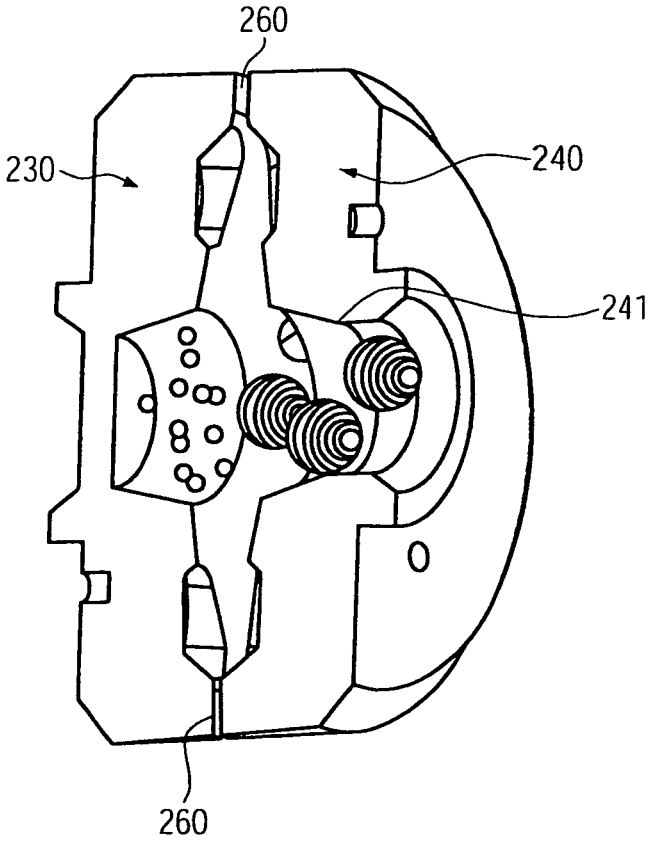
FIG. 11 shows further embodiments of the comminuting elements for a device according to the invention according to FIG. 6.

According to FIG. 11 a further embodiment of the comminuting elements according to the present invention is shown.

Figure 12:
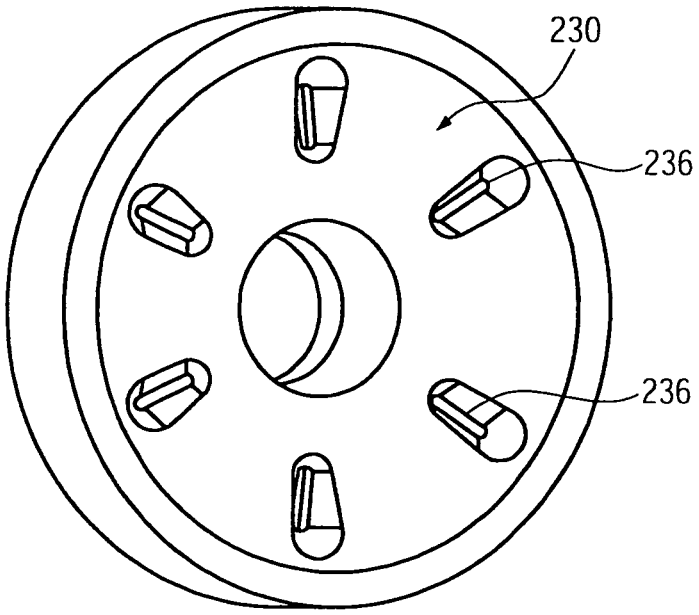
FIG. 12 shows diagrammatically a comminuting element of FIG. 11.
Figure 13:
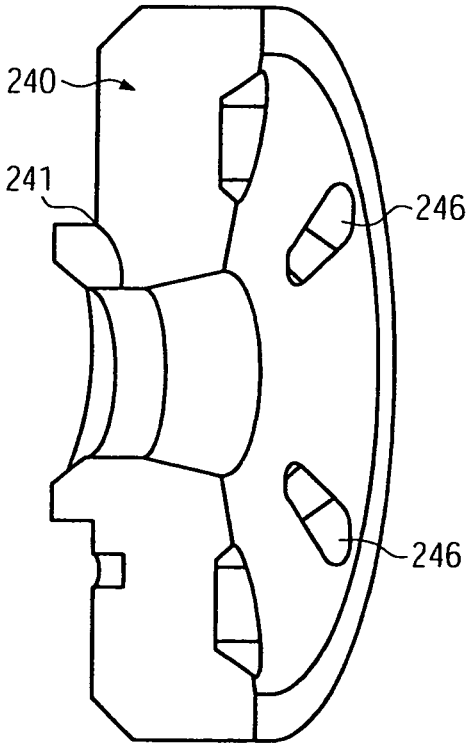
FIG. 13 shows the other comminuting element of FIG. 1, partially as a cross-section.

Alternatively to the comminuting elements according to FIGS. 7 to 10, in FIGS. 11 to 13 further embodiments for co-operating comminuting elements are shown which can be arranged within the device according to the invention according to FIG. 6.

In FIG. 11 a fixed element 240 and a rotating turning element 230 are shown, the ore 50 to be comminuted being fed via the feed opening 241 into the comminuting space between the fixed element 240 and the turning element 230. As can be seen, furthermore, from FIG. 11, the comminuting space between the fixed element 240 and the turning element 230 is formed such as to taper substantially conically outwards from the axis of rotation of the turning element 230, by means of which on the one hand pulverisation of the ore is brought about. On the other hand it is evident from FIG. 12 that the turning element 230 has recesses 236 which are arranged equal distances apart around the axis of rotation of the turning element. By means of the cross-overs of the recess 236 arranged at an angle, these recesses 236 provide in particular acceleration and so pulverisation of the ore due to the rotation which provides a relative movement between the turning element 230 and the fixed element 240.

FIG. 13 shows the fixed element 240 of FIG. 11 which co-operates with the turning element 230 of FIG. 12. The fixed element 240 shows in the cross-section in FIG. 13 the feed opening 241. Similarly to the turning element 230 the fixed element 240 has recesses 246 in the radial direction around the centre of the axis of rotation. In particular, the sloped regions of the recesses 236, 246 of the turning element 230 and the fixed element 240 provide acceleration and comminution of the ore which is discharged outwards in pulverised form through the intermediate space 260 between the turning element 230 and the fixed element 240.

According to the invention a method for comminuting ore and/or in particular slag is thus provided, the ore feed unit 1 being provided for feeding ore 50 to be comminuted to a pulveriser. The pulveriser is composed of at least two comminuting elements 30, 40 that can be moved relative to each other, which elements form a comminuting space for the ore to be comminuted with each other such that by a relative moment in the form of a rotation of at least one of the two comminuting elements 30, 40 the ore to be comminuted is pulverised in that one or more accelerating elements, in particular protrusions, are provided on at least one of the comminuting elements 30, 40, said accelerating elements being arranged in particular on the end face of one of the two comminuting elements 30, 40, and accelerating and comminuting the ore to be comminuted by the rotation of one of the two comminuting elements 30, 40. Between the two comminuting elements 30, 40 and/or in at least one of the two comminuting elements an intermediate space 60 is provided through which during the rotation the pulverised ore is conveyed away outwards from the centre of the rotation or from the axis of rotation of the turning element and from the two comminuting elements 30, 40. The ore pulverised in this way between the two comminuting elements is discharged outwards through the outlet unit which is connected to the intermediate space 60.

Purely optionally, during the comminuting process water can also be fed into the comminuting chamber through a water inlet 520 or by feeding water through the ore feed unit. The water thus forms together with the ore during and after pulverisation a sludge-like compound, the water being conveyed away through the outlet unit together with the pulverised ore.

As already explained with regard to FIG. 8, the ramp region 31 is particularly advantageous for the comminuting of slag because such a ramp region on the turning element provides pre-comminution of slag by means of the rotation of the turning element, protrusions and/or recesses being provided according to the invention in the comminuting elements after the ramp region in the direction of conveyance in order to pulverise the particularly brittle and hard slag.

For the person skilled in the art it is quite obvious that the number of protrusions on the two comminuting elements can respectively be equal, it also being possible, however, to provide a different number of accelerating elements on the two comminuting elements.

According to one embodiment (not shown), the two comminuting elements can rotate in opposite directions in order to increase the relative movement between the two comminuting elements. However, this leads to greater structural complexity, and is only to be implemented in special cases.

In particular, the shape of the comminuting chamber which is formed by the two comminuting elements can be of different designs, different types of accelerating element being able to be arranged in plate-shaped or wedge-shaped or some similar form by means of which the ore to be comminuted is accelerated and so pulverised between the two comminuting elements.

According to one embodiment (not shown), in addition to the comminuting between the two comminuting elements, a further comminuting chamber can also be provided which is provided independently of the two comminuting elements, but is however integrated into the device according to the invention.

A device according to the invention and a method according to the invention for comminuting ore and/or in particular slag are thus described which comprise an ore feed unit for feeding ore to be comminuted to a pulveriser, the pulveriser being composed of at least two comminuting elements that can be moved relative to each other, which elements form at least one comminuting space for the ore to be comminuted with each other such that, by a relative movement in the form of a rotation of at least one of the two comminuting elements the ore to be comminuted is pulverised in that one or more accelerating elements, in particular protrusions, are provided on at least one of the comminuting elements, said accelerating elements being arranged in particular on the end face of at least one of the two comminuting elements and accelerating and comminuting the ore to be comminuted by the rotation of one of the two comminuting elements, and there being provided between the two comminuting elements and/or in at least one of the two comminuting elements an intermediate space through which during the rotation the pulverised ore can be conveyed away outwards from the centre of the rotation and from the two comminuting elements, and an outlet unit being provided which is connected to the intermediate space through which the pulverised ore is discharged.

What is claimed is:

1. An ore-comminuting-device comprising:

an ore feed unit for feeding ore to be comminuted;

a pulveriser configured to receive ore from the ore feed unit, the pulveriser including at least two comminuting elements that form at least one comminuting space for the ore to be comminuted such that, by relative movement in the form of rotation of one or more of the comminuting elements, the ore to be comminuted is able to be pulverised, wherein one or more accelerating elements are provided on at least one of the comminuting elements, the one or more accelerating elements being arranged on an end face of the at least one of the comminuting elements and configured to accelerate and comminute the ore to be comminuted by the rotation of the one or more comminuting elements, the one or more accelerating elements including at least one protrusion and/or at least one recess configured to act on the ore to be comminuted to move the ore away from the one or more accelerating elements in such a way that parts of the ore accelerated by the one or more accelerating elements strike other parts of the are in the at least one comminuting space forming a micro-impact by means of which the ore is pulverised;

an intermediate space provided between two of the at least two comminuting elements and/or in at least one of the comminuting elements through which during the rotation the pulverised ore can be conveyed away outwards from the centre of the rotation and from the comminuting elements; and an outlet unit in communication with the intermediate space through which the pulverised ore is able to be discharged;

wherein at least one of the comminuting elements has a rising ramp region in a circular form for accelerating and comminuting the ore to be comminuted.

2. The device according to claim 1 wherein the at least one protrusion and the at least one recess each have an angular region at an angle in relation to the end face of the at least one of the comminuting elements by means of which the ore to be comminuted is able to be accelerated in the direction of the comminuting space due to the rotation of the one or more comminuting elements, or wherein the at least one protrusion or the at least one recess has an angular region at an angle in relation to the end of the at least one of the comminuting elements by means of which the ore to be comminuted is able to be accelerated in the direction of the comminuting space due to the rotation of the one or more comminuting elements.

3. The device according to claim 1 wherein the one or more accelerating elements comprise one or more accelerating elements on each of two of the at least two comminuting elements, and wherein the two comminuting elements are rotatable at different speeds.

4. The device according to claim 1 wherein the comminuting elements include a stationary fixed element and a rotatable turning element, the fixed element having substantially in its centre a feed opening for feeding the ore to be comminuted, and wherein the device further comprises a housing that accommodates the fixed element and the turning element, the housing including the outlet unit.

5. The device according to claim 4 wherein the turning element can be set in rotation, at least relative to the fixed element, by means of a motor, the at least one comminuting space includes a comminuting space being formed between the fixed element and the turning element by corresponding recesses being provided in at least the turning element and/or the fixed element so that the ore is able to be pulverised by the relative movement between the fixed element and the turning element.

6. The device according to claim 4 wherein the at least one comminuting space includes a comminuting space between the fixed element and the turning element that is formed substantially conically tapering outwards from the axis of rotation of the turning element.

7. The device according to claim 4 further comprising a gearing mechanism or an adjustable belt drive for varying the rotation of the turning element.

8. The device according to claim 4 wherein the turning element has a ramp region with a rising incline for accelerating and comminuting the ore to be comminuted.

9. The device according to claim 8 wherein the ramp region is provided after the feed opening of the fixed element and before the one or more accelerating elements in the direction of conveyance of the ore.

10. The device according to claim 8 wherein there is provided on the fixed element a ramp region which co-operates with the ramp region of the turning element in such a way that the ore to be comminuted is able to be accelerated and comminuted by both ramp regions.

11. The device according to claim 4 wherein the intermediate space is provided between the turning element and the fixed element, and the intermediate space can be adjusted in the axial direction of the rotation by a variable distance between the turning element and the fixed element, the intermediate space comprising star-shaped outlet notches in the turning element and/or the fixed element leading away from the axis of rotation of the turning element.

12. The device according to claim 11 further comprising a hydraulic device for adjusting the variable distance between the turning element and the fixed element in the axial direction.

13. The device according to claim 1 wherein the pulveriser has a water inlet through which a predetermined amount of water is able to be fed to the ore to be comminuted.

* * * * *

UNITED STATES PATENT AND TRADEMARK OFFICE

CERTIFICATE OF CORRECTION

PATENT NO. : 8,800,900 B2
APPLICATION NO. : 13/499432
DATED : August 12, 2014
INVENTOR(S) : Gharagozlu It is certified that error appears in the above-identified patent and that said Letters Patent is hereby corrected as shown below:

In the Claims

Column 11, Line 24, Claim 1:

After "strike other parts of the"
Delete "are" and
Insert -- ore --

Signed and Sealed this
Ninth Day of December, 2014

Michelle K. Lee

Michelle K. Lee
*Deputy Director of the United States Patent and Trademark Office*